United States Patent [19]

Guiler

[11] Patent Number: 4,551,999

[45] Date of Patent: Nov. 12, 1985

[54] LOCK ASSEMBLY FOR ENCLOSURE COVER

[75] Inventor: Richard S. Guiler, Newton, N.J.

[73] Assignee: Fuji Electric Co., Ltd., Kanagawa, Japan

[21] Appl. No.: 462,979

[22] Filed: Feb. 1, 1983

[51] Int. Cl.[4] ..... B65D 55/14

[52] U.S. Cl. ..... 70/159; 70/63

[58] Field of Search ..... 292/205, 208, 256.5, 292/282, 283, 285; 70/32, 54, 63, 77, 159, 164, 166, 170, 230, 232, 371, 422; 411/2, 3, 5

[56] References Cited

U.S. PATENT DOCUMENTS

| | | | |
|---|---|---|---|
| 876,028 | 1/1908 | Taylor | 70/422 X |
| 1,343,851 | 6/1920 | Roe | 70/159 X |
| 1,696,523 | 12/1928 | Cochran | 411/5 |
| 4,037,515 | 7/1977 | Kesselman | 411/3 |
| 4,049,313 | 9/1977 | Lundberg | 70/159 X |
| 4,120,182 | 10/1978 | Michelman et al. | 70/63 |
| 4,144,729 | 3/1979 | Nielsen, Jr. | 70/63 |
| 4,254,647 | 3/1981 | Finck, Jr. | 70/63 X |
| 4,475,365 | 10/1984 | Swisher | 70/159 |

*Primary Examiner*—Robert L. Wolfe

*Attorney, Agent, or Firm*—Brumbaugh, Graves, Donohue & Raymond

[57] ABSTRACT

A housing for receiving a lock of the so-called "barrel-lock" type for locking closed the hinged cover of an electric meter box or the like. The housing comprises a support block for attachment to the meter box, and a lock housing hinged to the block. The housing carries a meter box cover retainer which, when the housing is in the closed position and locked by the barrel lock, extends in front of the cover of the meter box and prevents it from being opened.

The housing and the support block have openings which are aligned when the housing is in the closed position, to receive the barrel lock. To protect the lock from shear forces which would be applied thereto by an interloper attempting to force the housing open, a shroud is provided in the aligned openings to surround the assembled lock. The shroud, when the housing is closed and locked, extends across the junction of the housing opening and the lock opening, and is retractable when the lock is removed to allow the housing to be swung to the open position.

7 Claims, 4 Drawing Figures

LOCK ASSEMBLY FOR ENCLOSURE COVER

BACKGROUND OF THE INVENTION

Increasing vandalism against electricity supply equipment and theft of electricity has created a need for better locks for electric meter boxes. In the past it has been common to provide a lock assembly which comprises a housing attached to the box in such a manner that the box cover cannot be opened when the housing is in place. The housing is locked in place by a lock of the barrel-lock type.

Such devices that are in common use have the disadvantage that they must be disassembled from the box to allow the box to be opened by service personnel, and the device must then be replaced after the box is closed. Such a procedure is time consuming and also provides the possibility that components of the assembly can be misplaced or lost.

An improved device is disclosed in a co-pending application Ser. 286,583 filed July 24, 1981 by James A. Swisher and now U.S. Pat. No. 4,475,365. In this device, a support block is attached to the meter box, and a housing is hinged to the support block, so that a portion of the housing can swing in front of and away from a position in front of the meter box cover. Aligned openings in the support block receive a barrel lock, so that opening of the housing when the barrel lock is in place is resisted by the shear strength of the barrel lock.

SUMMARY OF THE INVENTION

This invention provides a meter box lock assembly which is permanently assembled to the meter box, so that to open the box, it is not required to remove any component except the barrel lock itself. For this purpose a support block is mounted onto the side of the meter box, and a housing is hinged to the support block, said housing being capable of being pivoted between a locking and a non-locking position. The housing and the support block contain apertures which are aligned when the housing is in the locking position, which apertures open to the front of the assembly to receive a barrel lock. A lock shroud is assembled into the housing opening, said shroud being movable axially in the housing opening between a forward position in which the shroud extends from the housing opening into the support block opening to prevent the housing from moving to the open position, and rear position in which it is retracted from the support block opening. The shroud is dimensioned to receive the support block internally, whereby the shroud absorbs shear forces resulting from attempts to pry the lock open, and protects the barrel lock from such forces.

DESCRIPTION OF THE ILLUSTRATED EMBODIMENT

Figure 1:
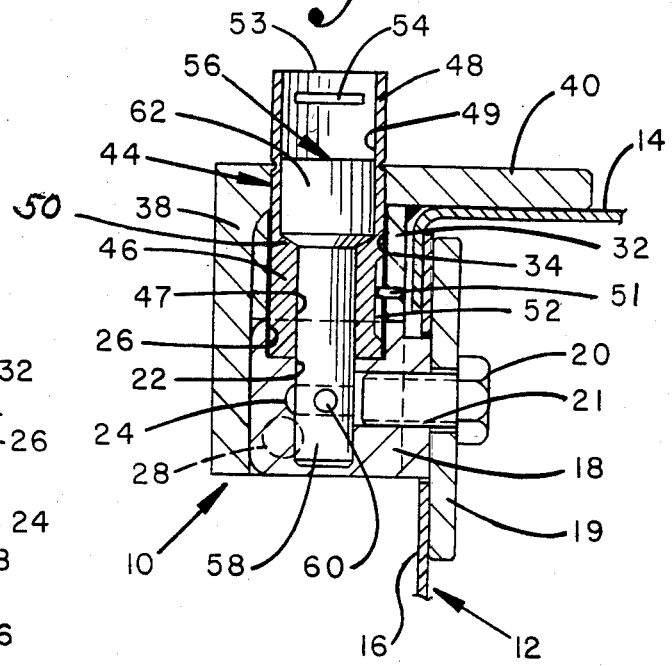
FIG. 1 is a top plan view of a meter box locking assembly, partly in section, embodying the features of the invention, with the assembly being in the locked position, and with the barrel lock locked into the assembly.

Referring to the drawing, there is illustrated a meter box lock assembly 10 which is designed for attachment onto a meter box 12 to lock the cover thereof in the closed position.

The assembly 10 is intended for attachment onto a sidewall 16 of the box 12 on the side opposite to that on which the cover 14 is hinged, and comprises a support block 18 which is mounted onto the exterior of the sidewall by suitable means, such as a bolt 20 extending through a washer 19 disposed on the inside of the box 12 and an aperture in the side wall into engagement with a threaded hole 21 in the block 18.

The block 18 also has a lock receiving aperture 22 extending perpendicular to the screw. The aperture 22 has an interior peripheral recess 24 to receive locking elements of a lock, as will appear hereinafter.

A circular recess 26 is provided on the face of the block 18 concentric with the aperture 22 to receive a locking shroud to be described.

Hinged to the outside forward corner of the support block 18 by pins 28 is a lock housing 30, which comprises a solid portion 32 having an aperture 34 which is positioned to be aligned with the lock receiving aperture 22 when the housing is in the closed position (See FIGS. 1 and 2), forwardly extending side walls 36 which are disposed on the top and bottom of the support block 18 and receive the pins 28, and an outer wall 38, which in the illustrated embodiment of the invention also extends around the front of the solid portion 32 and extends laterally therefrom to form the box cover retainer 40.

The walls 36 and 38 form a cavity 42 into which the support block 18 is received when the housing is in the closed position.

A lock shroud 44 is disposed in the aperture 34 of the housing 30, said shroud being generally in the form of a hollow cylinder dimensioned to receive a barrel lock 56 internally, and having a relatively thick wall portion 46 at the forward end forming an internal aperture 47 to receive the shank of the barrel lock and a thinner wall portion 48 at the rear end forming a larger internal aperture 49 to receive the head of the barrel lock, the junction of said apertures forming a shoulder 50.

The shroud 44 is axially movable in the aperture 34 between a forward position in which the forward end of the shroud enters into the circular recess 26 in the support block 18, and a rear position in which the forward end of the shroud is retracted from the circular recess 26.

The axial motion of the shroud may be limited by an convenient means, such as by a pin 51 in the housing 30 projecting into a suitable slot 52 on the exterior surface of the shroud.

The shroud has a length such that even in the forward position, the rear end portion 53 of the shroud projects outwardly from the housing, and is provided with opposing slots 54 to receive a seal (not shown).

A barrel lock 56 of the type intended for use in the lock housing comprises an elongated shank 58 having locking balls 60 at the forward end which may be retracted to release the lock from a housing into which it is assembled, and an enlarged head 62 at the other end, said shank 58 and said head 62 having an internal aperture containing lock operating mechanism (not shown). Locks of the type to be used with the housing assembly of this invention are well known in the art. One type is shown in U.S. Pat. No. 4,063,434 issued Dec. 20, 1977. Such locks are customarily assembled into a lock receiving aperture by mounting the lock onto the forwardly protruding operating pin of a lock operating tool (not shown) Such tools are well known in the art, are described in various patents, such as U.S. Pat. No. 3,446,045.

Figure 2:
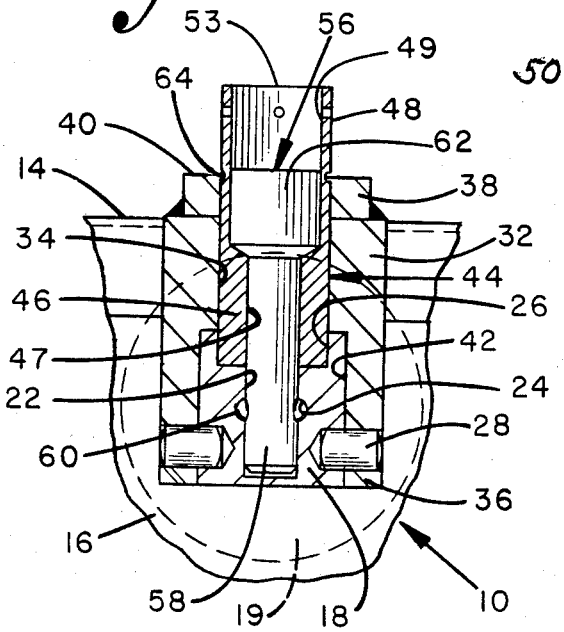
FIG. 2 is a view of the assembly of FIG. 1 as seen from the right side, partly in section.
Figure 3:
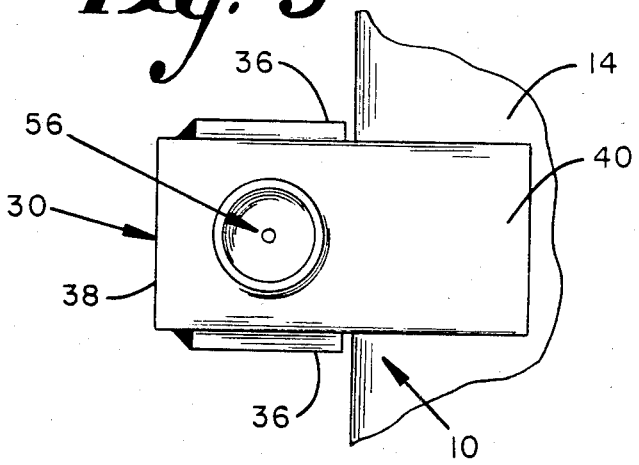
FIG. 3 is a front plan view of the assembly of FIGS. 1 and 2.
Figure 4:
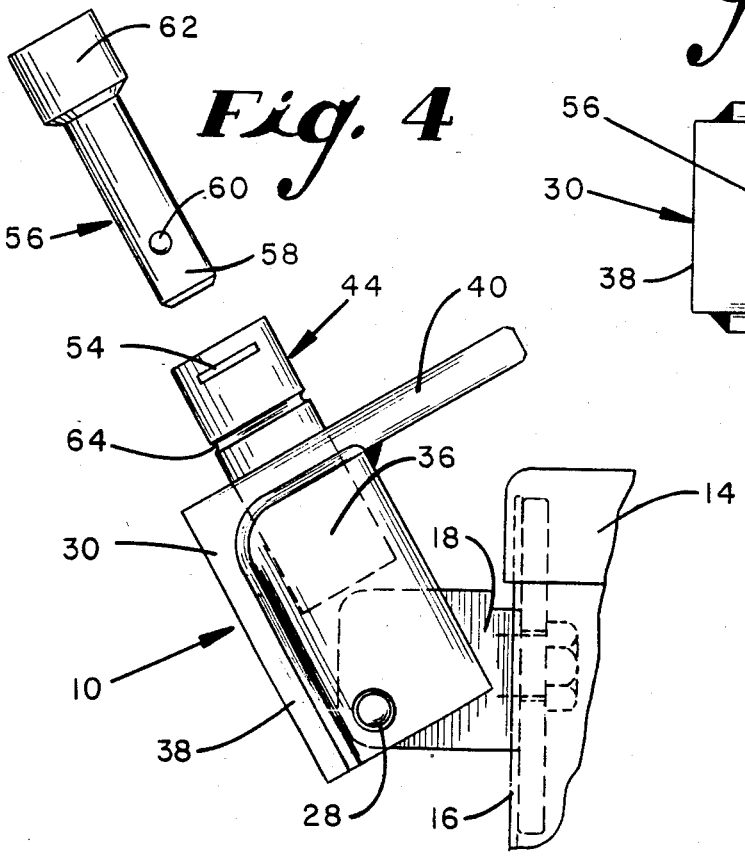
FIG. 4 is a top plan view of the assembly in the open or un-locked position, with the shroud retracted and the barrel lock removed.

After the housing assembly is attached to the sidewall 16 of the meter box 12, and the cover 14 closed, the housing is swung from the open position of FIG. 4 to the closed position of FIGS. 1–3, so that the cover retainer 40 is positioned in front of the adjacent edge of the cover. The lock 56 may then be assembled by placing the lock onto the end of the lock operating tool (not shown), operating the tool to allow the locking balls 60 to retract, and pushing the lock 56 into the shroud 44 until the forward end of the lock enters the aperture 22 in the support block, in which position the forward end of the shroud is disposed in the circular recess 26 in the forward end of the support block.

The position of the peripheral groove 24 is such that when the lock is fully inserted as above described, release of the tool allows the balls to project laterally into the groove, thereby retaining the lock and shroud locked in the housing.

Since the thick wall portion 46 of the shroud extends from aperture 34 of housing 30 into the circular recess 26 in support block 18 and across the junction between the housing 30 and the support block 18, attempts to open the housing by prying on the cover retainer are resisted by the shear strength of the shroud, and such shear forces are isolated from the barrel lock.

The resistance to tampering is therefore considerably greater than such devices that utilize the barrel lock alone to resist the shear forces, since the wall of the shank of the barrel lock is relatively thin with considerably less resistance to deformation. Also, shear forces applied to the shroud do not damage the lock and make it difficult or impossible to remove, as is the case when only a barrel lock is used.

in the illustrated embodiment of the invention the shroud is provided with an exterior peripheral groove 64 which is so positioned axially that it will be disposed at the outer surface of the cover retainer 40 when the assembly is closed and locked. The groove 64 provides a weakened portion which permits the projecting portion 53 of the shroud to be easily broken off, to allow access to the lock by special tools sometimes needed for its removal.

Since certain changes apparent to one skilled in the art may be made in the herein described embodiments of the invention without departing from the scope thereof, it is intended that all matter contained herein be interpreted in an illustrative and not a limiting sense.

I claim:

1. A lock housing assembly for attachment to a container having a cover to enable said assembly to retain the cover in the closed condition, said assembly comprising a support for attachment to a side wall of the housing, a cover retainer hinged to the support and being movable between an open and a closed position, said support and said cover retainer having apertures which are aligned when the cover retainer is in the closed position, a shear force resisting member retained in said cover retainer and movable in said retainer when said apertures are aligned, between a locking position in which said member extends into both apertures, and an unlocking position in which it does not extend between both apertures to allow said cover retainer to be moved to the open position to allow the cover to be opened, and removable means for locking the shear force resisting member in the locking position.

2. A lock housing assembly as set out in claim 1 in which said shear force resisting member is a hollow cylinder shaped and dimensioned to receive internally a barrel lock in a position such that the barrel lock can extend into locking engagement in the support.

3. A lock housing assembly for attachment to a container having a cover to receive a lock of the barrel lock type to enable said assembly to retain the cover in the closed condition, said assembly comprising a support for attachment to a side wall of the housing, a cover retainer hinged to the support, said support and said cover retainer having apertures which are aligned when the cover retainer is in the cover retaining position, and a hollow cylindrical lock shroud retained in the cover retainer aperture, said lock shroud being shaped and dimensioned to receive the barrel lock and being movable in the cover retainer, when the cover retainer is in the cover retaining position, between a locking position in which the forward end of the shroud extends into the support aperture to prevent pivoting movement of the cover retainer in relation to the support and a non-locking position in which the forward end of the shroud is clear of the support aperture, said shroud, when in the locking position, isolating the barrel lock from shear forces resulting from attempts to open the cover by prying on the cover retainer.

4. A lock housing assembly for attachment to a container having a cover, to receive a lock of the barrel lock type to enable said assembly to prevent the cover from being opened, said assembly comprising a support having an aperture with a forward portion sized to receive a barrel lock shank in locking engagement and a larger rear portion, a cover retainer hinged to the support so as to be movable about the hinge between a closed cover retaining position and an open position which allows the cover to be opened and having an aperture corresponding in size to the rear portion of the support aperture and positioned to be aligned therewith when the cover retainer is in the closed position, a lock shroud retained in the cover retainer aperture and being movable between a forward or locking position in which the forward end of the shroud extends into the rear portion of the cover retainer to prevent movement of the cover to the open position, and a rear or unlocking position in which the forward end of the shroud is clear of the support to allow the cover retainer to be moved to the open position, the assembled barrel lock retaining the shroud in the forward position.

5. An assembly as set out in claim 4 in which the shroud has a relatively thick forward wall portion an aperture portion sized to closely receive the shank of the barrel lock and a thinner rear wall portion forming an aperture portion that closely receives the head of the barrel lock, said shroud portion with the thicker wall spanning the interface between the cover retainer aperture and the rear portion of the support aperture when the cover retainer is in the closed position.

6. An assembly as set out in claim 5 in which the shroud has a length that when the cover retainer is in the closed position and the barrel lock is assembled, the shroud protrudes from the face of the cover retainer, and the protruding portion having a peripheral weakened portion to enable said protruding portion to be readily broken off.

7. A lock housing assembly for attachment to a side wall of a container having a removable cover, to retain the cover in the closed condition, said assembly comprising a support block for attachment to the wall of the container, a cover retainer hinged to the support block and being pivotable between an open condition and a closed condition, said support block and said cover retainer having apertures which are aligned when the cover retainer is in the closed position and which move out of alignment when the cover retainer is pivoted to the open position, a sleeve retained in the cover retainer aperture so as to be movable axially therein between a forward locking position in which, when the cover retainer is closed, the sleeve extends from the cover retainer aperture into the support block aperture to prevent pivoting movement of the cover retainer about the support block, and a retracted position in which the sleeve does not extend into the support block aperture, said sleeve being shaped and dimensioned to receive a barrel lock having expansible locking elements on the forward end in a manner such that the forward end of the barrel lock extends into the support block aperture, said support block having means for receiving said expansible locking elements to lock the barrel lock in the sleeve and the sleeve in the forward locking position.

* * * * *